US008757258B2

(12) United States Patent
Hager et al.

(10) Patent No.: US 8,757,258 B2
(45) Date of Patent: Jun. 24, 2014

(54) CASCADING LIQUID AIR REMOVAL FILTER SYSTEM AND METHOD

(76) Inventors: Terry Hager, Texhoma, OK (US); Pam Hager, Texhoma, OK (US)

( * ) Notice: Subject to any disclaimer, the term of this patent is extended or adjusted under 35 U.S.C. 154(b) by 283 days.

(21) Appl. No.: 13/204,653

(22) Filed: Aug. 6, 2011

(65) Prior Publication Data

US 2013/0032342 A1 Feb. 7, 2013

(51) Int. Cl.
*E21B 43/02* (2006.01)

(52) U.S. Cl.
USPC ..... 166/276; 166/105.5

(58) Field of Classification Search
USPC ..... 166/276, 105.5, 173; 417/904
See application file for complete search history.

(56) References Cited

U.S. PATENT DOCUMENTS

| | | | | |
|---|---|---|---|---|
| 672,475 | A | 4/1901 | Cavallaro | |
| 3,039,533 | A | 6/1962 | Lacey | |
| 3,392,785 | A | 7/1968 | King | |
| 3,493,045 | A | 2/1970 | Bassani | |
| 4,484,626 | A | 11/1984 | Kerfoot et al. | |
| 5,226,485 | A | 7/1993 | Dobscha et al. | |
| 5,392,853 | A | 2/1995 | Toon | |
| 2003/0159828 | A1 * | 8/2003 | Howard et al. | 166/372 |
| 2006/0048934 | A1 * | 3/2006 | Charabin | 166/177.7 |

* cited by examiner

*Primary Examiner* — Cathleen Hutchins
(74) *Attorney, Agent, or Firm* — Shannon L Warren

(57) ABSTRACT

A cascading liquid air removal filter system is disclosed. Said system comprising a filter system having a bristles element. Said bristle element comprises a plurality of bristles each having a first end and a second end. Said bristles element comprises a plurality of fluid passages between said bristles. Said filter system is attached to a column of a well having one or more sections, between said column and a casing of said well. Said filter system comprises a filter outside diameter. Said casing comprises a casing internal diameter. Said filter outside diameter is equal to or larger than said casing internal diameter. Said fluid passages comprise a plurality of non-linear paths through said bristles element for a liquid passing through said filter system. Said filter system provides only said non-linear paths for said liquid to travel from a first end to a second end of said filter system.

9 Claims, 6 Drawing Sheets

CASCADING LIQUID AIR REMOVAL FILTER SYSTEM AND METHOD

BACKGROUND

This disclosure relates generally to a cascading liquid air removal filter system and method. In one embodiment, this disclosure relates to said cascading liquid air removal filter system and method installed in a well containing a water pump installed therein. In another embodiment, said cascading liquid air removal filter system and method can be installed in a well producing liquids other than water, such as an oil from an oil well.

In one embodiment, said water pump installed in said well can comprise a centrifugal pump. In one embodiment, said centrifugal pump can be a rotodynamic pump that uses a rotating impeller to increase the pressure of a fluid. Said fluid enters said rotating impeller along or near a rotating axis of said rotating impeller and accelerated by said impeller, flowing radially outward into a diffuser or volute chamber (casing), from where it exits into a downstream piping system. In one embodiment, said water pump can comprise a turbine pump (i.e., a pump driven by a shaft driven form above surface), or a submergible pump. In one embodiment, said submergible pump can comprise an electrical pump located below a liquid surface and proximate to a bottom end of a well casing wherein a pipe contains and electrical line to said water pump.

When used in a water pump, water pumps (such as a centrifugal pump) encounter many problems. First, pumps with an impeller can become worn with continuous use, especially where said impeller encounters friction due to suspended solids in a liquid being pumped. Next, pumps can overheat due to low flow in liquid. Where pumps become worn, they can thereby have leakage occur along the rotating shaft. Further, many pumps, such as centrifugal pumps, must be filled with a fluid to be pumped in order to operate; that is, many pumps will not operate unless primed. In many cases, where a pump casing becomes filled with vapors or gases, said pump's impeller becomes gas-bound and incapable of pumping.

In one embodiment, to ensure that a centrifugal pump remains primed and does not become gas-bound, said centrifugal pumps are placed below a fluid source level, from which the pump is to take its suction. The same effect can be gained by supplying liquid to said pump's intake under pressure supplied by another pump placed in a suction line. Such an embodiment fails to account for air in said fluid source pushed below said fluid source level by cascading water. For example, in one embodiment, a water pump can be placed under water below a water level; wherein, said water pump typically draws said water into said pump but occasionally draws in air pushed below said water level by cascading water splashing at said water level.

In one embodiment, a pump can comprise one or more bowls which spin to push liquid through said pump. Where air is introduced into a fluid intake of said pump, non-uniformity at said fluid intake causes said bowls to cut a cast iron shell of said pump.

Systems and method for filtering air from cascading liquid have evolved over the years. In one embodiment, an elastic tube device is inserted into a cased well wherein said elastic tube device consists of (i) an elastic tube, a pipe having an inner bore, said pipe extending through said elastic tube, said elastic tube annularly surrounding an expansion space; (ii) tube clamps capable of fixedly attaching said upper and lower ends of the elastic tube to the outer surface of said pipe; and (iii) fluid transfer apertures capable of carrying fluids from the inner bore of the pipe to said expansion space. Wherein, said fluid transfer apertures interconnecting said expansion space and said inner bore of said pipe so that, upon extension of the device into said cased well, and upon introduction of a pressurized water into said inner bore of said pipe, water may flow from said inner bore of said elastic tube to expand radially outward into contact with said cased well's casing. Said embodiment sets out to enhance the function of an impeller or centrifugal pump installed within wells, allowing such pumps to create a pressure differential or vacuum effect at the water inlet ports of said well without drawing down said water level within said well. Such an embodiment leaves much to be desired in practice however. In one embodiment, said elastic tube becomes clogged and filled with solid materials, such as sand. Further, said elastic tube device is not easily removed from said cased well when defective. In one embodiment, complexity in removing said elastic tube device is encountered where said elastic tube when a material is lodged within said elastic tube and causes a counter weight to efforts at pulling said elastic tube device from said cased well. Another shortcoming of said elastic tube device is a relatively slow flow rate of liquids through said elastic tube device. Still further, another limitation of said elastic tube device occurs where a user cannot determine a static water level prior to installing said elastic tube device and therefore may accidentally block water flow between said water pump and a water source below said static water level. That is, said elastic tube device can seal holes in a casing wall in said well casing where a portion of said elastic tube pushes against said holes.

In another embodiment, a throttle valve is introduced below ground level in a well ("downhole") to continuously regulate the flow of water during recharge, injection or aquifer storage recovery. Said throttle valve include two concentric cylinders or tubular members, one of which has flow control ports, the other is connected to and selectively moved by a hydraulic actuator section, thereby setting the flow through the ports by varying their size. An inner tubular member with said control ports is stationery and an outer tubular member is moved vertically by hydraulic pressure in a double acting hydraulic actuator section. Speed of operation is adjusted by adjusting a hydraulic fluid flow control valve. Accordingly, said embodiment attempts filter air from cascading liquids by introducing a throttle valve between a fluid source and a pump. Nonetheless, said embodiment has many shortcomings. First, said inner and outer tubular members are prone to failure downhole. For example, said double acting hydraulic actuator section of said outer tubular member could easily fail and become lodged downhole. Also, variable speed of operation by said hydraulic fluid flow control valve is not necessary for the filtering of air in cascading fluids.

Accordingly, a system and/or method for filtering air from cascading liquid would be advantageous.

SUMMARY

Two cascading liquid air removal filter systems and one method are disclosed. First, a cascading liquid air removal filter system is disclosed comprising a filter system having a bristles element. Said bristle element comprises a plurality of bristles each having a first end and a second end. Wherein said filter system is attached to a column of a well having one or more sections, between said column and a casing of said well, and above a drawdown liquid level within said well.

Next, a cascading liquid air removal filter method is disclosed. Said method comprising minimizing a flow of a plurality of air bubbles into a pump under a liquid and in a well by attaching a filter system to a column of a well between said column and a casing and above a drawdown liquid level within said well, and slowing a cascading liquid prior to splashing a liquid surface by forcing said cascading liquid to trickle through said filter system. Said liquid comprises said liquid surface at a top surface of said liquid in said well. Said liquid comprises said cascading liquid while falling toward said liquid surface. Said drawdown liquid level comprises a liquid level when said pump is pumping. Said well comprises said drawdown liquid level and a static liquid level. Said static liquid level comprises said liquid level when said pump is not pumping. Said filter system comprises a plurality of bristles.

Finally, a cascading liquid air removal filter system is disclosed. Said system comprising a filter system having a bristles element. Said bristle element comprises a plurality of bristles each having a first end and a second end. Said bristles element comprises a plurality of fluid passages between said bristles. Said filter system is attached to a column of a well having one or more sections, between said column and a casing of said well. Said filter system comprises a filter outside diameter. Said casing comprises a casing internal diameter. Said filter outside diameter is equal to or larger than said casing internal diameter. Said fluid passages comprise a plurality of non-linear paths through said bristles element for a liquid passing through said filter system. Said filter system provides only said non-linear paths for said liquid to travel from a first end to a second end of said filter system.

DETAILED DESCRIPTION

Described herein is a cascading liquid air removal filter system and method. The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers' specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

Figure 1A:
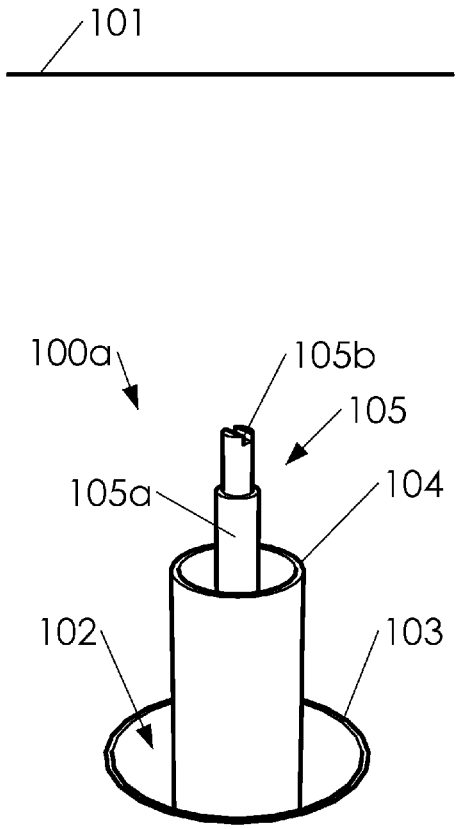
FIGS. 1A and 1B illustrate an above ground view of a turbine pump configuration and a submergible pump configuration, respectively.
Figure 1B:
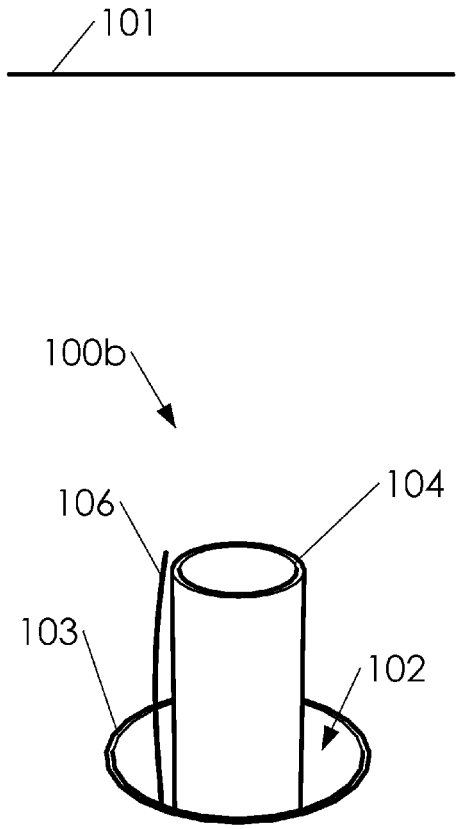

FIGS. 1A and 1B illustrate an above ground view of a turbine pump configuration 100*a* and a submergible pump configuration 100*b*, respectively. Cascading liquid air removal filter system and method can comprise a well 100. Well 100 can comprise turbine pump configuration 100*a* and submergible pump configuration 100*b*. In one embodiment, well 100 can be installed into a surface 101 by drilling a bore 102 in surface 101 and inserting well 100 into bore 102, as is known in the art. Well 100 can comprise a casing 103 and a column 104. In one embodiment, turbine pump configuration 100*a* can comprise a tubing-shaft 105. Tubing-shaft 105 can comprise a tubing 105*a* and a shaft 105*b*. In one embodiment, shaft 105*b* can rotate freely within tubing 105*a*, as is known in the art. In one embodiment, submergible pump configuration 100*b* can comprise a wire 106.

Figure 2A:
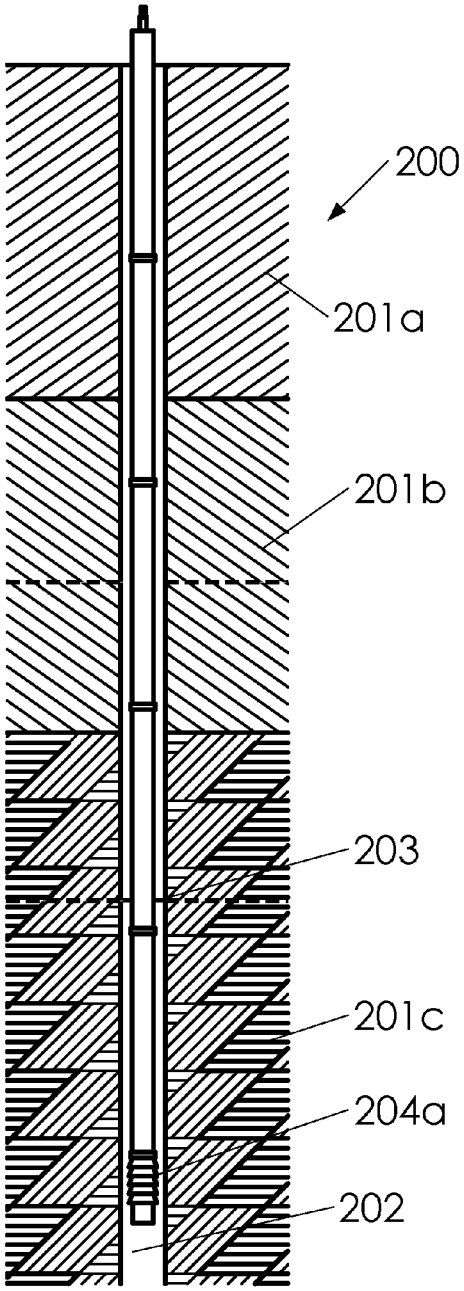
FIG. 2A illustrates turbine pump configuration in a cutaway view of surface exposing a subsurface.

FIG. 2A illustrates turbine pump configuration 100*a* in a cutaway view of surface 101 exposing a subsurface 200. Subsurface 200 can comprise a plurality of geological layers 201. In one embodiment, geological layers 201 can comprise a first layer 201*a*, a second layer 201*b*, and a third layer 201*c*, as shown in FIG. 2A. Subsurface 200 can further comprise a liquid 202. In one embodiment, liquid 202 can be held in geological layers 201. In one embodiment, bore 102 can comprise, an aperture in surface 101 extending into a subsurface 200 to a sufficient depth to access a liquid 202 from below surface 101. In one embodiment, liquid 202 can comprise water, oil, or some other liquid of significance. As is known in the art, liquid 202 can drain from subsurface 200 into well 100. In one embodiment, liquid 202 can accumulate in well 100 and form a liquid surface 203.

Figure 2B:
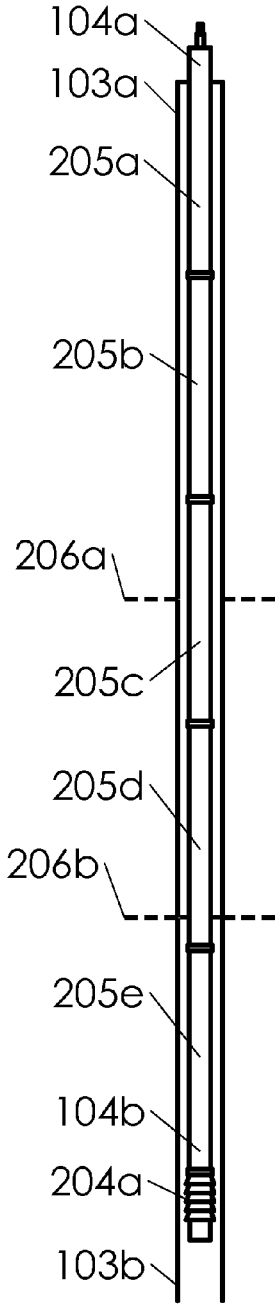
FIGS. 2B and 2C illustrate a side cutaway view of submergible pump configuration and turbine pump configuration, respectively.
Figure 2C:
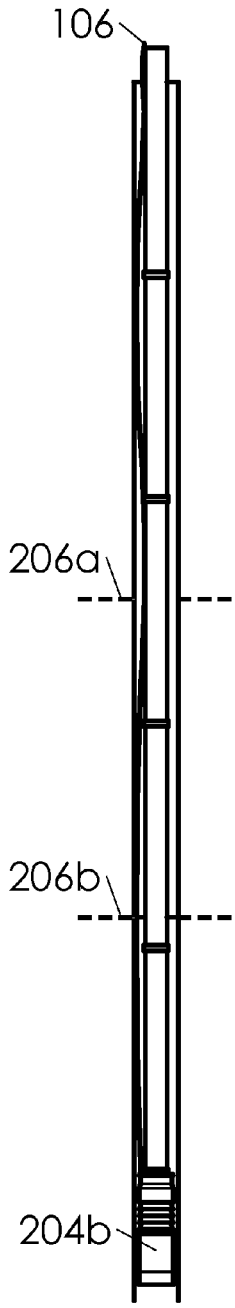

FIGS. 2B and 2C illustrate a side cutaway view of submergible pump configuration 100*b* and turbine pump configuration 100*a*, respectively. Casing 103 can comprise a top end 103*a* and a bottom end 103*b*. Column 104 can comprise a top end 104*a* and a bottom end 104*b*. Well 100 can comprise a pump 204. Pump 204 can comprise a variety of different pump types such as a centrifugal pump, a turbine pump 204*a*, and/or a submergible pump 204*b*. Column 104 can comprise one or more sections 205. Sections 205 can comprise a first section 205*a*, a second section 205*b*, a third section 205*c*, a fourth section 205*d*, and a fifth section 205*e*. In one embodiment, turbine pump configuration 100*a* can comprise turbine pump 204*a*. In one embodiment, turbine pump 204*a* can pump liquid 202 by attaching a rotary power source to a first end of shaft 105*b*, attaching a second end of shaft 105*b* to turbine pump 204*a*, and driving shaft 105*b* with said rotary power source. In one embodiment, submergible pump configuration 100*b* can comprise submergible pump 204*b*. In one embodiment, submergible pump 204*b* can pump liquid 202 by attaching submergible pump 204*b* to bottom end 104*b*, attaching a second end of wire 106 to submergible pump 204*b*, running a first end of wire 106 above surface 101, applying power to submergible pump 204*b* through wire 106, and pumping liquid 202 from bottom end 104*b* to top end 104*a*. In one embodiment, liquid surface 203 can rise and fall to one or more liquid levels 206 within well 100 as liquid 202 is static or pumping out of well 100. For example, in one embodiment, liquid surface 203 can comprise a static liquid level 206*a* and a drawdown liquid level 206*b*. In one embodiment, static liquid level 206*a* can comprise a state of liquid level 206 wherein liquid surface 203 would naturally occur as pump 204 is not pumping. In one embodiment, drawdown liquid level 206*b* can comprise a state of liquid level 206 wherein liquid surface 203 would occur as pump 204 is pumping.

Figure 3A:
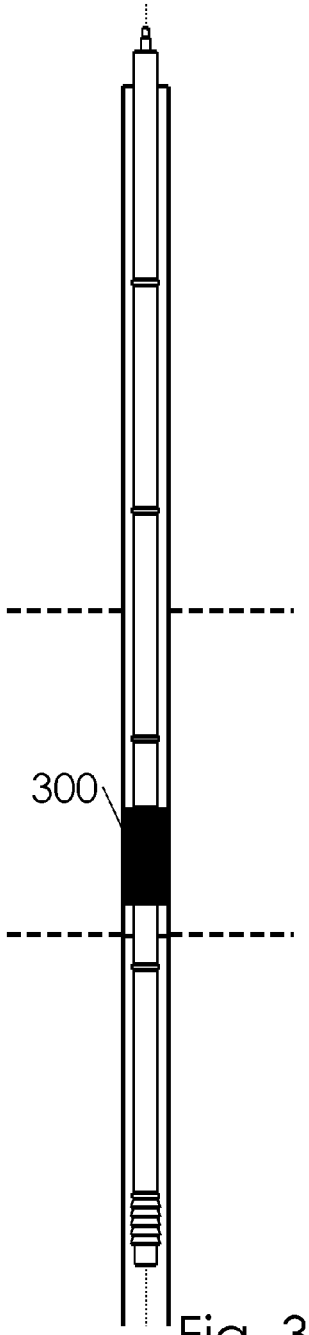
FIGS. 3A and 3B illustrate an overview and detailed view of well with a filter system, respectively.
Figure 3B:
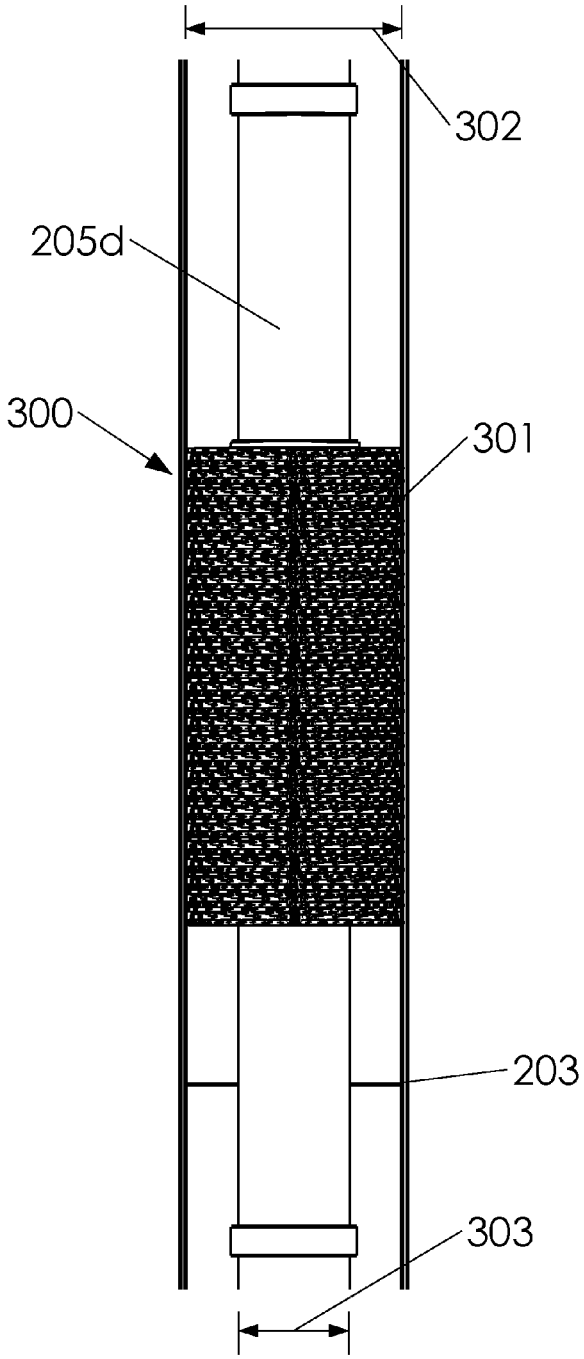

FIGS. 3A and 3B illustrate an overview and detailed view of well 100 with a filter system 300, respectively. Filter system 300 can comprise one of sections 205 and a bristles element 301. In one embodiment, filter system 300 can comprise bristles element 301 apart from one of sections 205. In one embodiment, filter system 300 can be attached around and to fourth section 205*d*. In one embodiment, bristles element 301 can substantially fill a cavity between casing 103 and column 104. In one embodiment, bristles element 301 can attach substantially above drawdown liquid level 206*b*. In one embodiment, wherein filter system 300 comprises a bristles element 301 and one of sections 205, filter system 300 can replace one of sections 205 lacking said bristles element 301. In one embodiment, wherein filter system 300 only comprises bristles element 301, filter system 300 can attach to column 104 by sliding filter system 300 around an outer parameter of column 104. In one embodiment, filter system 300 can be attached to column 104 by welding a portion of filter system 300 to a portion of column 104. Casing 103 can comprise a casing internal diameter 302. Column 104 can comprise a column external diameter 303.

Figure 4A:
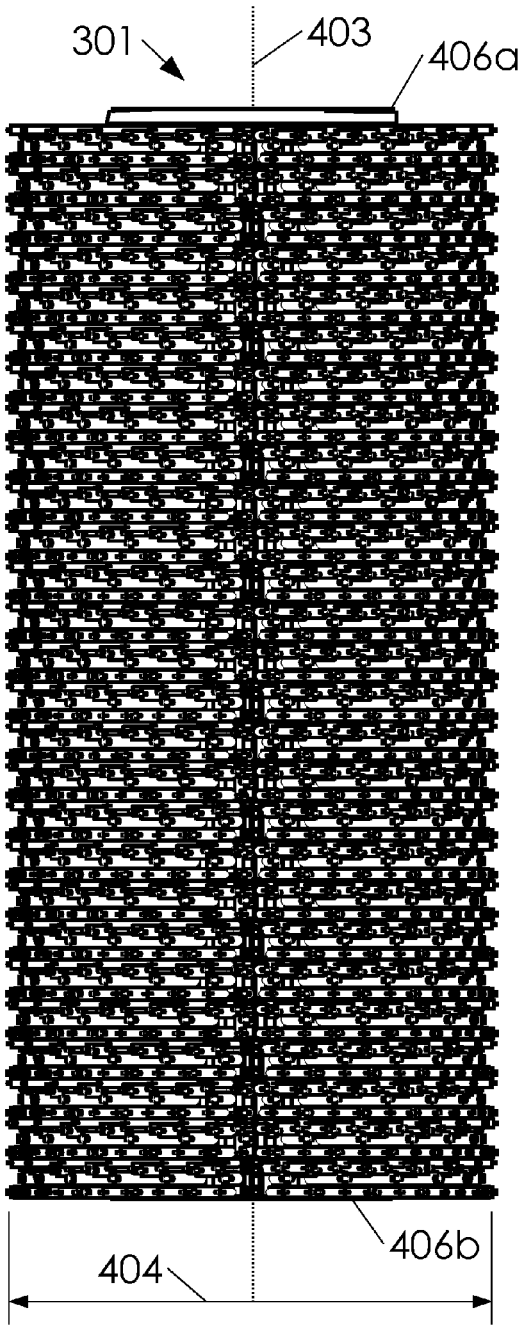
FIGS. 4A, 4B, and 4C illustrate a side view, top view, and an overview of bristles element.
Figure 4B:
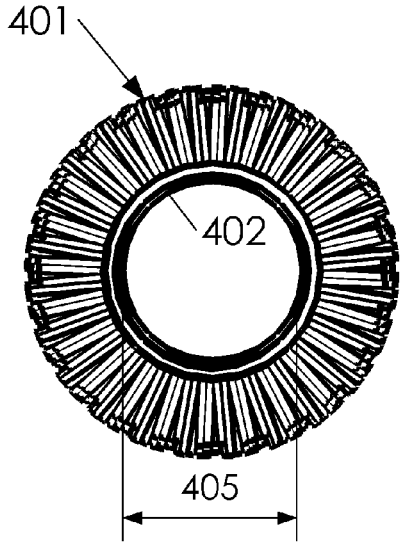
Figure 4C:
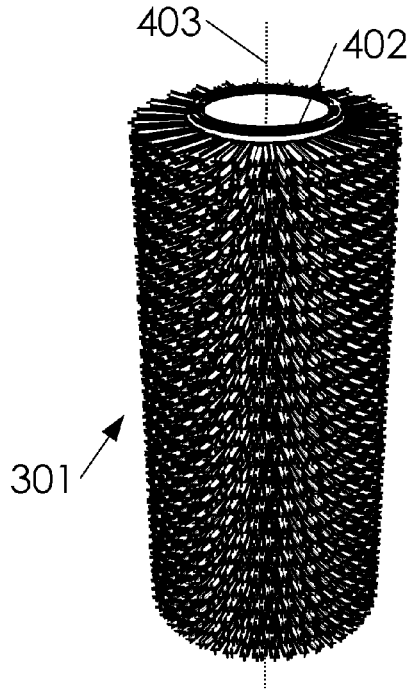

FIGS. 4A, 4B, and 4C illustrate a side view, top view, and an overview of bristles element 301. Bristles element 301 can comprise a plurality of bristles 401, a central portion 402, a central axis 403 and a filter outside diameter 404. In one embodiment, central portion 402 can comprise a substantially long hollow cylinder comprising a central portion internal diameter 405. In one embodiment, central portion internal diameter 405 can be substantially equal to or slightly larger than column external diameter 303; wherein, central portion 402 can slide around column 104. In one embodiment, bristles 401 can comprise a first bristle 401*a*, a second bristle 401*b*, and so on. In one embodiment, bristles element 301 can comprise a central axis 403 along a substantially vertical line at the center of central portion 402. In one embodiment, bristles 401 can attach to central portion 402 at one end and extend in a plurality of substantially horizontal directions away from central axis 403. In one embodiment, bristles 401 can comprise a bristle material capable of holding said substantially horizontal direction. In one embodiment, said bristle material comprises polypropylene. In another embodiment, said bristle material comprises plastic, or similar. In yet another embodiment, said bristle material can comprise a metal. In one embodiment, bristles 401 can comprise wire. In one embodiment, bristles 401 can attach along an external surface of central portion 402. In one embodiment, bristles 401 cover said external surface of central portion 402 from a first end 406*a* to a second end 406*b* of central portion 402, as illustrated in FIGS. 4A-4C. In one embodiment, bristles 401 can attach to a portion of said external surface of central portion 402. In one embodiment, bristles 401 can attach in a plurality of groupings between first end 406*a* and second end 406*b* such that there are gaps in bristles 401 along filter system 300. In one embodiment, filter outside diameter 404 can be slightly larger than casing internal diameter 302. For example, in one embodiment, filter outside diameter 404 can be 16" and casing internal diameter 302 can be 15.5", but these diameters are exemplary and not required for cascading liquid air removal filter system and method to properly function. In one embodiment, bristles 401 can scrape and clean a portion of casing 103 during installation by inserting bristles element 301 into top end 103*a*, pushing bristles element 301 down into well 100 toward bottom end 103*b*, and scraping bristles 401 against an internal surface area of casing 103.

Figure 5A:
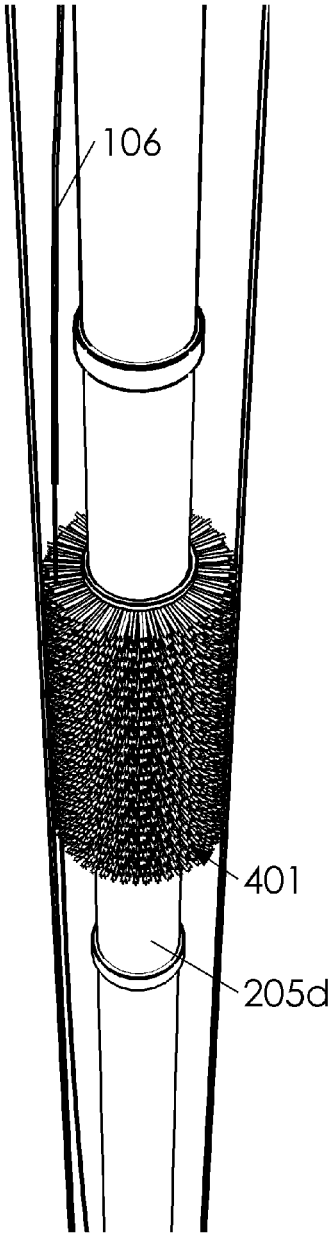
FIGS. 5A, 5B, and 5C illustrate a top overview and detailed view, and a below overview of filter system in a cutaway section of casing, respectively.
Figure 5B:
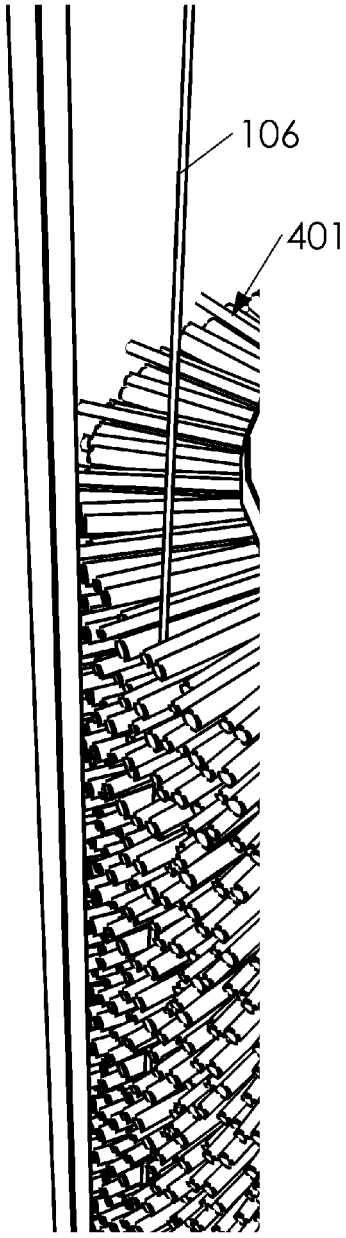
Figure 5C:
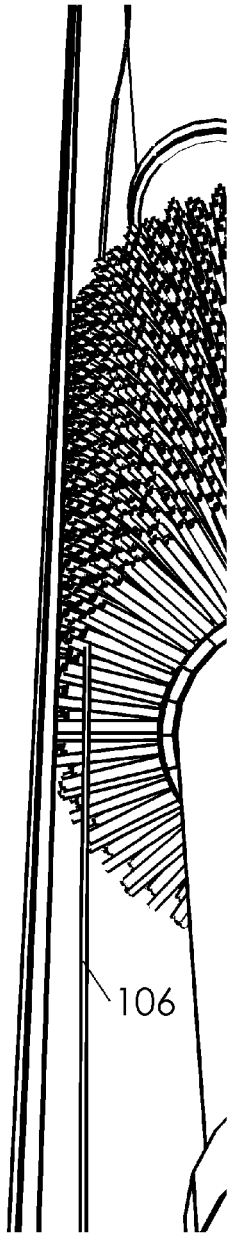

FIGS. 5A, 5B, and 5C illustrate a top overview and detailed view, and a below overview of filter system 300 in a cutaway section of casing 103, respectively. In one embodiment, bristles element 301 can comprise a plurality of fluid passages between bristles 401; wherein, said fluid passages can each comprise a non-linear path through bristles element 301 for a fluid passing through filter system 300. For example, in one embodiment, wire 106 can pass through filter system 300 by pulling wire 106 from first end 406*a* to second end 406*b* through bristles 401; however, wire 106 is forced to take one of said fluid passages through filter system 300. Likewise, in one embodiment, liquid 202 can pass through filter system 300 along one or more said fluid passages through filter system 300.

Figure 6:
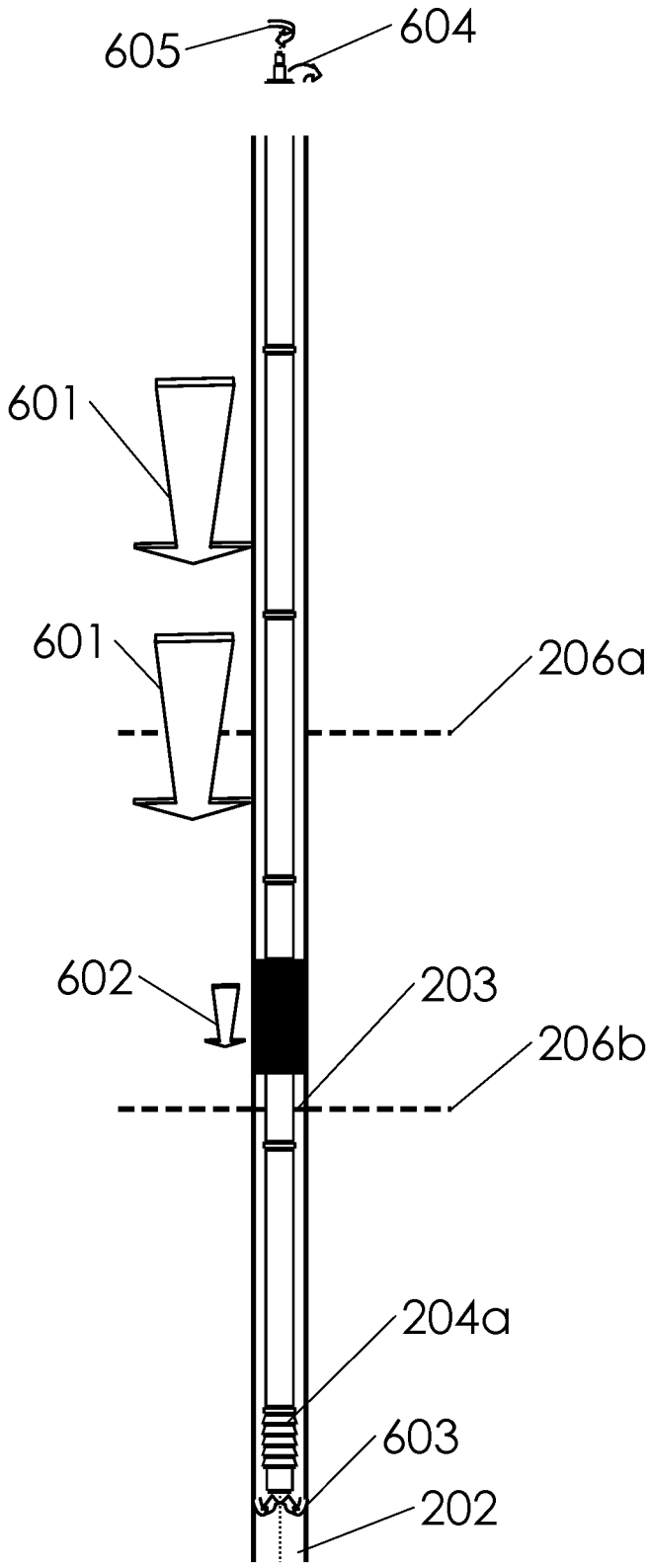
FIG. 6 illustrates a detailed view of filter system arranged between static liquid level and drawdown liquid level.

FIG. 6 illustrates a detailed view of filter system 300 arranged between static liquid level 206*a* and drawdown liquid level 206*b*. Liquid 202 can comprise a cascading liquid 601, a trickling liquid 602, a pumping liquid 603, and a produced liquid 604. In one embodiment, cascading liquid 601 can comprise liquid 202 in an uninterrupted falling acceleration from subsurface 200 toward liquid surface 203. In one embodiment, said uninterrupted falling acceleration can comprise liquid 202 falling due to the pull of gravity down well 100. In one embodiment, as cascading liquid 601 splashes said liquid surface 203 a plurality of air bubbles can become injected into liquid 202 and thereafter said air bubbles can damage pump 204. In one embodiment, said bubbles can damage pump 204 by pulling said air bubbles into pump 204. In one embodiment, cascading liquid air removal filter system and method can comprise minimizing the flow of said air bubbles to pump 204 by attaching filter system 300 to well 100 and slowing cascading liquid 601 prior to splashing liquid surface 203. In one embodiment, slowing cascading liquid 601 can comprise attaching filter system 300 above drawdown liquid level 206*b* and between casing 103 and column 104, forcing cascading liquid 601 to pass through bristles 401, and thereby slowing cascading liquid 601 into trickling liquid 602. In one embodiment, attaching filter system 300 to well 100 can comprise attaching filter system 300 around one of sections 205, substantially above drawdown liquid level 206*b*, and substantially filling a space between casing 103 and column 104 with bristles 401. In one embodiment, cascading liquid air removal filter system and method can comprise attaching filter system 300 below static liquid level 206*a*. In one embodiment, forcing cascading liquid 601 to pass through bristles 401 can comprise blocking a portion of a space between static liquid level 206*a* and drawdown liquid level 206*b*. In one embodiment, blocking said portion of said space can comprise inserting filter system 300 between static liquid level 206*a* and drawdown liquid level 206*b*. Further, in one embodiment, slowing cascading liquid 601 into trickling liquid 602 can comprise trickling said liquid 202 through said non-linear path between first end 406*a* and second end 406*b* of filter system 300. In one embodiment, cascading liquid 601 trickles through bristles 401 by hitting a plurality of bristles 401 as cascading liquid 601 is pulled downward through filter system 300. In one embodiment, trickling liquid 602 drops from second end 406*b* to liquid surface 203 and collects below and around pump 204. In one embodiment, cascading liquid air removal filter system and method can minimize damage to pump 204 as well 100 produces liquid 202 by slowing liquid 202 from cascading liquid 601 to trickling liquid 602 with filter system 300, minimizing said air bubbles in liquid 202, pumping liquid 202 through column 104 from bottom end 104*b* to top end 104*a*, and collecting liquid 202 as it exits well 100 as produced liquid 604.

In one embodiment, cascading liquid air removal filter system and method can comprise installing filter system 300 in well 100. In one embodiment, installing filter system 300 can comprise determining static liquid level 206*a* and drawdown liquid level 206*b*, and attaching filter system 300 to a portion of column 104 corresponding to a location between static liquid level 206*a* and drawdown liquid level 206*b*. In one embodiment, determining static liquid level 206*a* can comprise testing one or more well conditions within well 100 without pump 204 pumping. In one embodiment, determining drawdown liquid level 206*b* can comprise estimating drawdown liquid level 206*b* based upon an average draw down distance in view of said well conditions. In another embodiment, determining drawdown liquid level 206*b* can comprise testing said drawdown level with pump 204 pumping. Other means of determining static liquid level 206*a* and drawdown liquid level 206*b* will be apparent to those skilled in the art herein discussed.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

The invention claimed is:

1. A cascading liquid air removal filter method comprising minimizing a flow of a plurality of air bubbles into a pump under a liquid and in a well by:

attaching a filter system to a column of a well between said column and a casing and above a drawdown liquid level within said well, slowing a cascading liquid prior to splashing a liquid surface by forcing said cascading liquid to trickle through a plurality of bristles in said filter system;

slowing said cascading liquid comprises forcing said cascading liquid to pass through said filter system and slowing said cascading liquid into a trickling liquid by blocking a portion of a space between a static liquid level and said drawdown liquid level, allowing said cascading liquid to penetrate said plurality of bristles along a one of a plurality of non-linear paths between a first end and a second end of said filter system, and trickling said liquid through said filter system and thereby slowing said cascading liquid into a trickling liquid;

trickling said cascading liquid through said filter system comprises hitting said cascading liquid with said plurality of bristles as said cascading liquid is pulled downward through said filter system; and wherein, said liquid comprises said liquid surface at a liquid level of said liquid in said well said liquid comprises said cascading liquid while falling toward said liquid surface, said drawdown liquid level comprises said liquid level when said pump is pumping, said static liquid level comprises said liquid level when said pump is not pumping, said filter system comprises said plurality of bristles, and said filter system comprises a bristles element having a plurality of bristles attached to a central portion of said filter system.

2. The cascading liquid air removal filter method of claim 1 wherein attaching said filter system to said column comprises installing said filter system by determining said static liquid level and said drawdown liquid level and attaching filter system to said column above said drawdown liquid level.

3. A cascading liquid air removal filter method comprising minimizing a flow of a plurality of air bubbles into a pump under a liquid and in a well by:

attaching a filter system to a column of a well between said column and a casing and above a drawdown liquid level within said well, slowing a cascading liquid prior to splashing a liquid surface by forcing said cascading liquid to trickle through a plurality of bristles in said filter system;

slowing said cascading liquid comprises forcing said cascading liquid to pass through said filter system and slowing said cascading liquid into a trickling liquid by blocking a portion of a space between a static liquid level and said drawdown liquid level, allowing said cascading liquid to penetrate said plurality of bristles along at least one of a plurality of non-linear paths between a first end and a second end of said filter system, and trickling said liquid through said filter system and thereby slowing said cascading liquid into a trickling liquid;

trickling said cascading liquid through said filter system comprises hitting said cascading liquid with said plurality of bristles as said cascading liquid is pulled downward through said filter system; and wherein, said liquid comprises said liquid surface at a liquid level of said liquid in said well, said liquid comprises said cascading liquid while falling toward said liquid surface, said drawdown liquid level comprises said liquid level when said pump is pumping, said static liquid level comprises said liquid level when said pump is not pumping, said filter system comprises said plurality of bristles, and said filter system comprises a bristles element having a plurality of bristles attached to a central portion of said filter system.

4. The cascading liquid air removal filter method of claim 3 wherein attaching said filter system to said column of said well comprises:

sliding said filter system around an outer parameter of said column; and wherein, said filter system comprises said central portion having a central portion internal diameter, said casing comprises a column external diameter, and said central portion internal diameter is equal to or larger than said column external diameter.

5. The cascading liquid air removal filter method of claim 3 wherein attaching said filter system to the column of the well further comprises:

securing said filter system to said column.

6. The cascading liquid air removal filter method of claim 5 wherein securing said filter system to said column further comprises:

welding a portion of said filter system to a portion of said column.

7. The cascading liquid air removal filter method of claim 5 wherein securing said filter system to said column further comprises:

replacing a one of a one or more sections in said column with said filter system.

8. The cascading liquid air removal filter method of claim 3 further comprising:

attaching each of a first ends of said plurality of bristles to an external surface of said central portion of said bristles element.

9. The cascading liquid air removal filter method of claim 3 wherein blocking said portion of said space between said static liquid level and said drawdown liquid level further comprises:

blocking a space between said casing and said column; wherein, a filter outside diameter is equal to or larger than a casing internal diameter, said casing internal diameter comprises an internal diameter of said casing, and said filter outside diameter comprises an external diameter of said filter system.

* * * * *